US010871043B2

(12) United States Patent
Marquez

(10) Patent No.: US 10,871,043 B2
(45) Date of Patent: Dec. 22, 2020

(54) WORKOVER /DRILLING RIG WITH FLOOR DRAINAGE SYSTEM

(71) Applicant: Randy Marquez, Westminister, CO (US)

(72) Inventor: Randy Marquez, Westminister, CO (US)

( * ) Notice: Subject to any disclaimer, the term of this patent is extended or adjusted under 35 U.S.C. 154(b) by 46 days.

(21) Appl. No.: 16/242,108

(22) Filed: Jan. 8, 2019

(65) Prior Publication Data

US 2020/0217155 A1 Jul. 9, 2020

(51) Int. Cl.

| | |
|---|---|
| ***E21B 41/00*** | (2006.01) |
| ***E21B 15/00*** | (2006.01) |
| ***E21B 21/015*** | (2006.01) |

(52) U.S. Cl.

CPC ..... *E21B 21/015* (2013.01); *E21B 41/005* (2013.01); *E21B 41/0021* (2013.01)

(58) Field of Classification Search

CPC ..... E21B 15/00; E21B 41/005

See application file for complete search history.

(56) References Cited

U.S. PATENT DOCUMENTS

| | | | | |
|---|---|---|---|---|
| 1,507,628 | A * | 9/1924 | Schuyler | E21B 21/01 166/84.1 |
| 5,167,277 | A * | 12/1992 | Evans | E21B 21/01 166/81.1 |
| 5,228,506 | A * | 7/1993 | Pearce | E21B 33/08 166/81.1 |
| 6,386,225 | B1 * | 5/2002 | Holtby | E21B 33/08 137/15.01 |
| 6,666,287 | B2 * | 12/2003 | Holtby | E21B 21/01 175/209 |
| 9,453,392 | B1 * | 9/2016 | Marchiori | E21B 33/08 |
| 10,392,895 | B1 * | 8/2019 | Pruitt | E21B 33/08 |
| 2019/0107246 | A1 * | 4/2019 | Lindsay | F16B 45/00 |

* cited by examiner

*Primary Examiner* — Kenneth L Thompson
(74) *Attorney, Agent, or Firm* — Daniel M. Cohn; Howard M. Cohn

(57) ABSTRACT

A spill container to be mounted below a rig floor. The spill container includes a collapsible concave container having an open top for catching fluid spilled on the rig floor, and a circular bottom opening adapted to receive a tubular member extending through the rig floor and downward below the concave container. The side walls of the concave container extend from the open top to the circular bottom opening. The open top of the concave container has a plurality of hangers extending there about to mount to the rig floor. An outer circumference of the open circular bottom opening has a plurality of hooks attached thereto for mounting to circular rings through which the tubular member extends outwardly therefrom.

17 Claims, 6 Drawing Sheets

WORKOVER /DRILLING RIG WITH FLOOR DRAINAGE SYSTEM

FIELD OF INVENTION

The present invention relates generally to the field of drainage systems for workover/drilling rigs. More specifically, the present invention relates to a system for collecting fluids. Such as drilling fluid, spilled onto the workover/drilling rig floor when sections of tubing/drill pipe are removed from the drill string.

BACKGROUND OF INVENTION

Generally, workover/drilling rigs have a pit, or area of ground beneath the rig, surrounding the tubing/drill pipe, which terminates in a wellhead. When sections of tubing/drill pipe are removed or "tripped out from the drill string during drilling operations, the column of drilling fluid contained in the pipe section spills onto the workover/drilling rig floor. These fluids spill over the edges of the workover/drilling rig floor and fall into the pit. The spilled fluids are not only a safety hazard for the workers on the rig site, they can be an environmental hazard depending on the composition of the fluids themselves.

For this reason, drainage systems are needed on workover/drilling rigs to collect drilling fluid spilled onto the rig floor to improve the safety of the rig floor for the workers and to collect the fluids before they reach the ground so that they can be recycled or properly disposed of.

It is, therefore, desirable to have a drainage system that can safely and efficiently collect drilling fluid that is spilled during the drilling and servicing of a well.

SUMMARY OF THE INVENTION

According to a first embodiment the present invention, there is disclosed a spill container to be mounted below a rig floor. The spill container includes a collapsible concave container having an open top for catching fluid spilled on the rig floor, and a circular bottom opening adapted to receive a tubular member extending through the rig floor and downward below the concave container. The side walls of the concave container extend from the open top to the circular bottom opening. The open top of the concave container has a plurality of hangers extending there about to mount to the rig floor. An outer circumference of the open circular bottom opening has a plurality of hooks attached thereto for mounting to circular rings through which the tubular member extends outwardly therefrom.

According to another embodiment the present invention, there is disclosed a spill container to be mounted below a rig floor. The spill container includes a first circular ring mounted to the rig floor. A collapsible concave container is mounted to the circular ring, having an open top for catching fluid spilled on the rig floor, and a circular bottom opening adapted to receive a tubular member extending through the rig floor and downward below the concave container. Side walls of the concave container extend from the open top to the circular bottom opening. The open top of the concave container has a plurality of hangers extending there about to mount to the circular ring. An outer circumference of the open circular bottom opening has a plurality of hooks attached thereto for mounting to a second circular ring.

BRIEF DESCRIPTION OF THE DRAWINGS

The structure, operation, and advantages of the present invention will become further apparent upon consideration of the following description taken in conjunction with the accompanying FIGS. (FIGS.). The FIGS. are intended to be illustrative, not limiting.

Certain elements in some of the FIGS. may be omitted, or illustrated not-to-scale, for illustrative clarity. The cross-sectional views may be in the form of slices, or near-sighted cross-sectional views, omitting certain background lines which would otherwise be visible in a true cross-sectional view, for illustrative clarity.

Often, similar elements may be referred to by similar numbers in various FIGURES (FIGS) of the drawing, in which case typically the last two significant digits may be the same, the most significant digit being the number of the drawing FIG.

FIG. 1 is a side view, partly in cross sectional, of a floor drainage system mounted to the underside of the floor of an oil rig, according to the present invention.

FIG. 1A is a three dimensional view of a drain, according to the present invention.

FIG. 1B is a three dimensional view of circular rings, according to the present invention.

FIG. 2 is a bottom view of the floor drainage system mounted to the underside of the floor of an oil rig, according to the present invention.

FIG. 3 is a side view of the floor drainage system of FIG. 2, mounted to the underside of the floor of an oil rig, according to the present invention.

FIG. 4 is a side view of an alternative embodiment of a floor drainage system mounted to the underside of the floor of an oil rig, according to the present invention.

FIG. 5 is a side view, partly in cross section, of a floor drainage system mounted to the underside of the floor of an oil rig, according to the present invention.

FIG. 6 is a view through line 6-6 of the floor drainage system of FIG. 5, according to the present invention.

FIG. 7 is an alternative embodiment of the floor drainage system of FIG. 5, according to the present invention.

DETAILED DESCRIPTION OF THE PREFERRED EMBODIMENT

Figures 1, 1A, 1B:
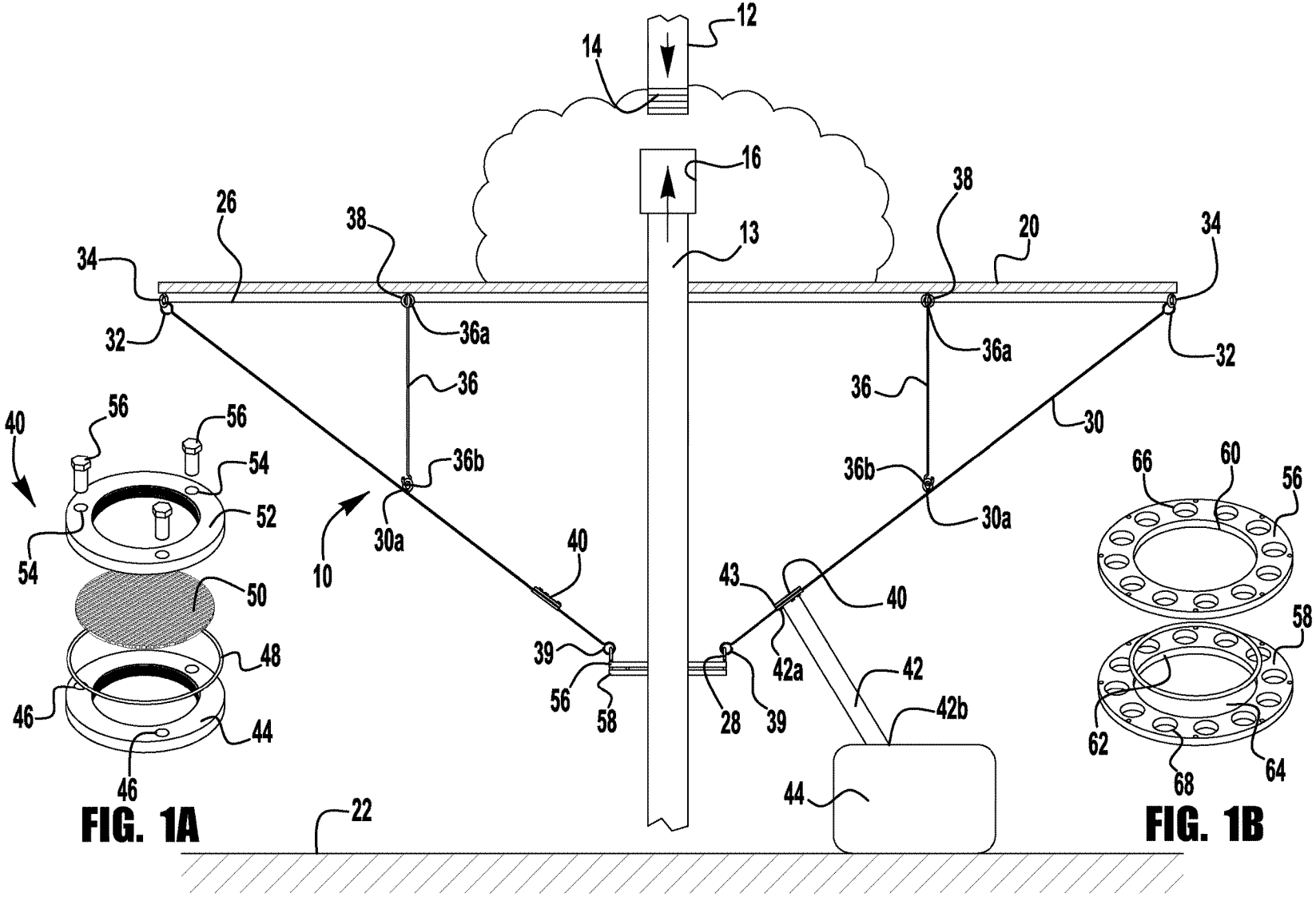

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

The present inventions will be described by reference to drawings showing examples of how the inventions can be made and used. In these drawings reference characters are used throughout the several views to indicate like or corresponding parts.

FIG. 1 illustrates one embodiment or example of an apparatus in the form of an improved spill container 10. The details of the construction and method of use of several embodiments of spill containers are illustrated and described with reference to FIGS. 1 through 7.

In these FIGS., a spill container 10 is shown assembled around a tubular member 13 which as illustrated can form a part of the oil well assembly. As will be described, the improved spill container 10 is designed to fit around a variety of types of tubular members 12 and 13 such as an oil well casing, an oil well pipe, and equipment attached to the oil well casing having annular portions such as the wellhead of the oil well, well spools, blow-out preventers and the like. The tubular members 12 and 13 can have end connections 16 which are either threaded, flanged, clamped, welded or the like.

One advantage of the spill container 10 of the present invention is that it can be installed on any well member with external tubular surfaces, without regard to the type of end connections and without the necessity of disassembling the well head.

Preferably when installed, the spill container 10 is positioned below a rig floor 20 of an oil well service rig (not shown) and above the surface 22 of the water or ground around the oil well. As shown in FIG. 1, a spill container 10 is mounted and projects below the rig floor 20. The spill container 10 has the general form of an inverted concave container 11, which is provided with an open top 26 for catching fluid spilled on the rig floor 20 and an circular bottom opening 28 adapted to receive the tubular member 13 so that the latter can extend downward below the spill container 10. The inverted concave container 11 of the spill container 10 as shown has a cone-like shape. The inverted concave container 11 of the spill container 10 extend from the circumference of the open top 26 to the circular bottom opening 28 and may curve outwardly so that they can be mounted to the underside of the rig floor 20 in a loose fashion. The outer circumference of the open top 26 of inverted concave container 11 has a plurality of hangers 32 extending there about to mount to hooks or loops 34 secured to the underside of the rig floor 20. The outer circumference of the open circular bottom opening 28 has a plurality of hooks 39 attached thereto for mounting to circular rings 56 and 58 as discussed hereinbelow. The inverted concave container 11 is collapsible, and constructed of flexible, leakproof material, such as for example, plastic, Polyurethane Laminate, a rubberized tarp, and nylon. The main qualities of the spill container 10 is that the fluid that collects in the inverted concave container 11 does not leak out and the material is strong enough to hold the collected without breaking or splitting.

To enable the concave container 11 to handle a higher weight of fluid, a plurality of additional hangers 36 can be mounted at one end 36*a* by hooks 38 to the underside of the rig floor 20 and at the opposite end 36*b* to the sidewall 30 of the concave container 11. The end 36*b* can be secured at a location 30*a* between the circular bottom opening 28 and the open top 26 of the sidewall 30.

One or more drains 40 can be mounted in the sidewall 30 near the circular bottom opening 28 so that oil or fluid collected in the concave container 11 can be directed out of the spill container and into a conduit 42 which is securely mounted at one end 42*a* to the drain 40 and at an opposite end 42*b* to a collection or storage tank 44. In some environments, spilled fluid will flow from the concave container 11 to the storage tank 44 by force of gravity. However, a suitable pump (not shown) can be provided in the conduit 42 to force flow to the storage tank 44. The storage tank 44 can be vented to atmosphere through a filter (not shown).

The drain 40 as shown in FIG. 1A can be constructed of an outer ring 44 having a plurality of threaded holes 46 therethrough. The outer ring 44 can be disposed on the outer surface 31 of the sidewall 30 at an opening 43 through the sidewall. An o-ring 48 can be disposed against the inner surface 33 of the sidewall 30 about the opening 43 through the sidewall. A screen 50 can be placed upon the o-ring 48 and secured in place with an inner ring 52 having a plurality of threaded holes 54 therethrough. The inner and outer rings 52 and 44, respectively, can be disposed with respect to each other so that the a plurality of threaded holes 46 and 54 are aligned so that bolts 56 can secure the inner and outer rings 52 and 44 to each other.

The circular bottom opening 28 can have two circular rings 56 and 58 mounted to thereto. The upper and bottom circular rings 56 and 58, as shown in FIG. 1B, each have a circular opening 60 and 62, respectively, therethrough which align with each other when the upper and bottom circular rings 56 and 58, respectively, are mounted to each other. The bottom circular ring has a collar 64 projecting outward there from. The collar 64 is adapted to be received within the circular opening 60 so that the upper and bottom circular rings 56 and 58 are aligned with each other. A plurality of bolts 39 which are secured to the outer circumference of the open circular bottom opening 28 can be attached to holes 66 and 68 which extend through the collars 56 and 58, respectively, and bolted together.

Figure 2:
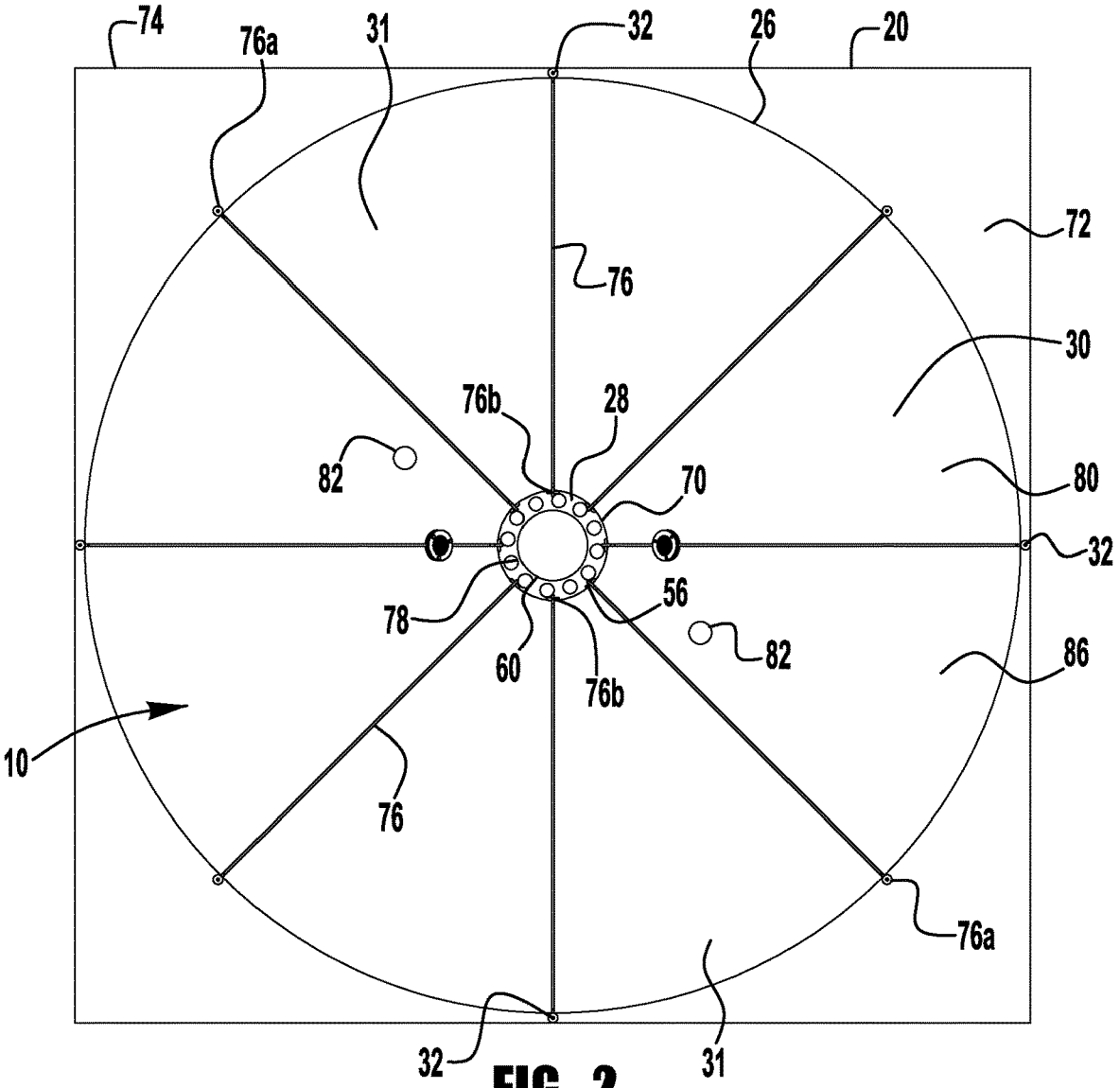

FIG. 2 is a bottom view of the concave container 11 of the spill container 10, as shown in FIG. 1, mounted to and projecting below the rig floor 20. Circular rings 56 and 58 (not shown) are mounted to the circular bottom opening 28. The upper and bottom circular rings 56 and 58 each have a circular opening 60 and 62 (not shown), respectively, therethrough which align with each other when the upper and bottom circular rings 56 and 58, respectively, are mounted to each other. The rings 56 and 58 are mounted to the underside of a rig floor 20 by a plurality of chains or straps 76 which are connected at an outer end 76*a* to the underside 72 of the rig floor 74 and at an opposite inner end 76*b* to the openings 78 in the circular rings 56 and 58. In a preferred embodiment, the circular rings 56 and 58 can have 12 openings 78 extending therethrough. While two circular rings 56 and 58 are shown, it is within the terms of the invention to use a single circular ring in place of the two circular rings.

Figure 3:
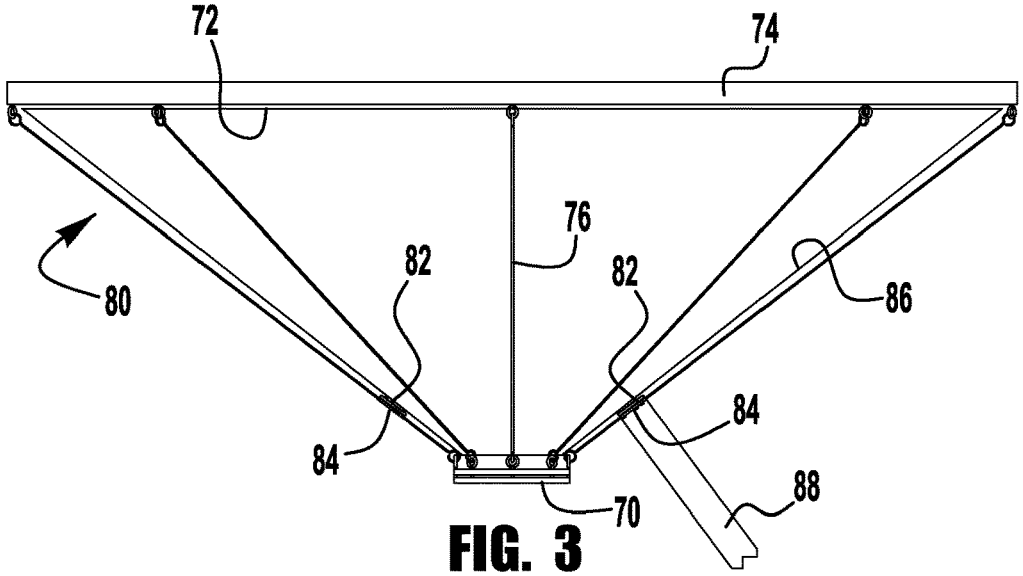

As shown in FIG. 3, the spill container 80, which is FIG. 3 is a side view of the floor drainage system of FIG. 2, mounted to the underside of the floor of an oil rig, according to the present invention. The spill container 80 can be secured to the underside 72 of the rig floor 74 and held in place by the plurality of adjustable chains or straps 76. The plurality of chains or straps 76 support the sidewall 86 of the spill container 80. The sidewall 86 of the spill container can have openings 82 in the sidewall 86 into which drains 84 (compare drains 40) can be mounted near the circular bottom opening 28 so that oil or other fluid collected in the spill container 80 can be directed out of the spill container and into a conduit 88 which is securely mounted at one end to the drain 84 and at an opposite end to a collection or storage tank as shown in FIG. 1.

An advantage of the embodiment shown in FIGS. 2 and 3 is that the plurality of chains or straps 76 can be lengthened or shortened depending on the particular requirements so that the spill container can be move closer or further from the rig floor 74.

Figure 4:
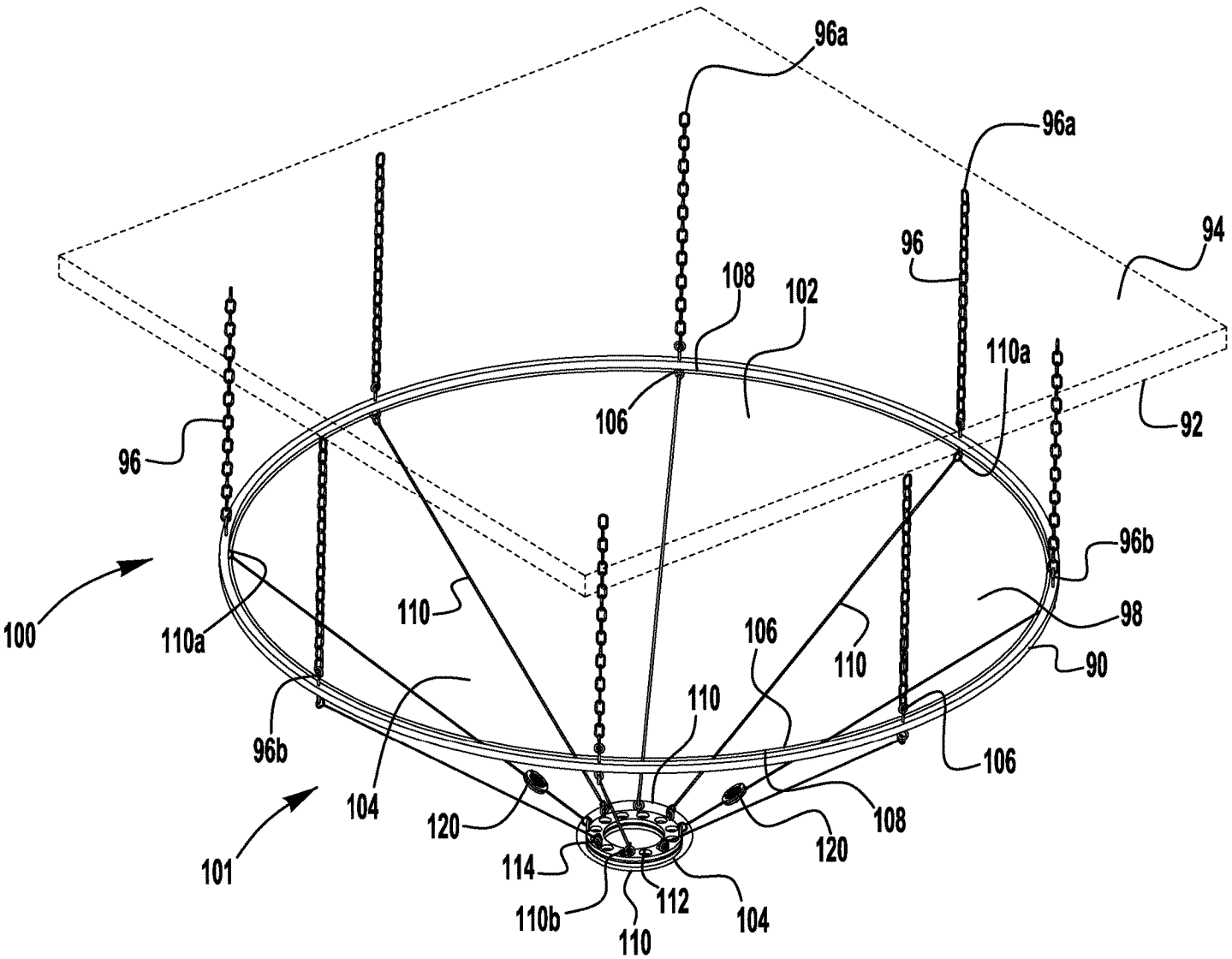

Referring to FIG. 4, there is illustrated a three dimensional view of spill container 100. The spill container 100 includes a concave container 101, having a first circular ring 90 mounted to the underside 92 of a rig floor 94 by a plurality of adjustable chains or adjustable traps 96 which are connected at an outer end 96*a* to the underside 92 of the rig floor 94 and at an opposite inner end 96*b* to the first circular ring 90. The chains or straps 96 can be lengthened or shortened depending on the particular requirements.

The flexible, leakproof material forming the side walls 98 of the concave container 101 has the generally a cone-like shape of an inverted concave container and is provided with an open top 102 for catching fluid spilled on the rig floor 94 and an circular bottom opening 104 adapted to receive a tubular member so that the latter can extend downward below the spill container 100. The side walls 98 of the concave container 101 extend from the circumference of the open top 102 to the circular bottom opening 104 and may curve outwardly so that they can be mounted to the underside of the rig floor 94 in a loose fashion. The outer circumference of the open top 102 of concave container 101 has a plurality of hangers 106 extending there about to mount to hooks or loops 108 secured to the underside of the ring 90. The outer circumference of the open circular bottom opening 104 has a plurality of hooks 110 attached thereto for mounting to second circular ring 114.

A plurality of chains or straps 110 are connected at an outer end 110*a* to the ring 90. The opposite inner end 110*b* are secured to openings 112 in second circular ring 114. In a preferred embodiment, the second circular ring 114 can have 12 openings 112 extending therethrough. The plurality of chains or straps 110 can be connected at an inner end 110*b* to the openings 112 in the second circular ring 114. The side walls 98 of the concave container 101 can be supported and held in place by the plurality of chains or straps 110. The side walls 98 can have openings 120 into which drains (compare drains 40) can be mounted near the circular bottom opening 104 so that oil collected in the spill container 100 can be directed out of the circular bottom opening 104 and into a conduit (not shown) as described hereinbefore.

Figure 5:
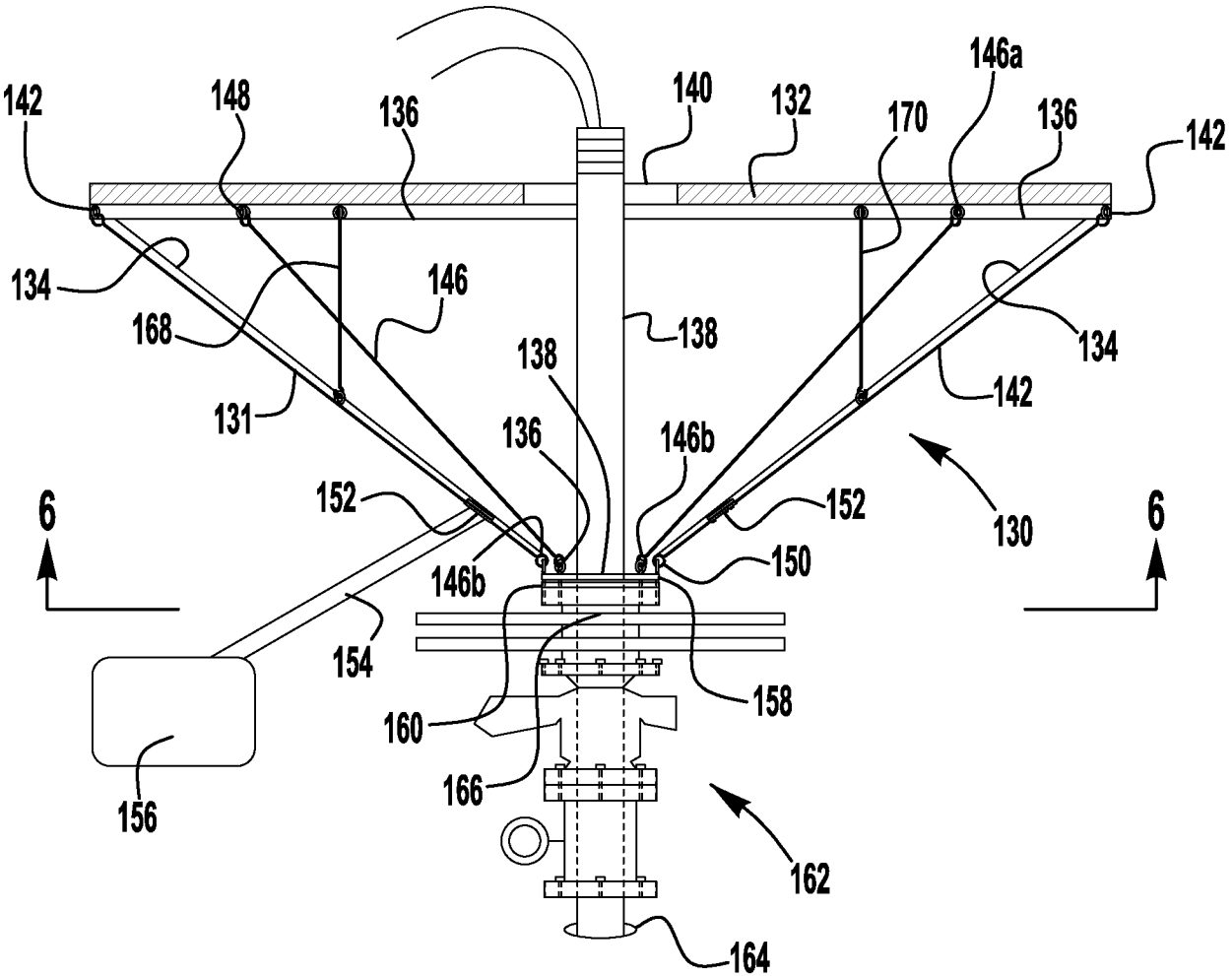

Referring to FIG. 5, another embodiment of a spill container 130 is mounted to the underside of the rig floor 132. Spill container 130, as generally shown and described with reference to FIG. 1, has a flexible, leakproof material forming the side walls 134 of a concave container 131 that has the generally a cone-like shape of an inverted concave container and is provided with an open top 136 for catching fluid spilled on the rig floor 132 and an circular bottom opening 138 adapted to receive a tubular member so that the latter can extend through an opening 140 in rig floor 132 and downward below the spill container 130 as described hereinafter. Although the side walls 134 of the concave container 131 are shown in a taut condition, they may curve outwardly so that they can be mounted to the underside of the rig floor 132 in a loose fashion. The outer circumference of the open top 136 has a plurality of hangers 142 extending there about to mount to hooks 148 secured to the underside of the rig floor 132. The outer circumference of the open circular bottom opening 138 has a plurality of hooks 150 attached thereto for attaching the open circular bottom opening 138 to the two circular rings 158 and 160, compare circular rings 56 and 58, mounted to thereto.

One or more drains 152 can be mounted in the sidewall 134 near the circular bottom opening 138 so that fluid collected in the sidewalls of the spill container 130 can be directed out of the spill container and into a conduit 154 which is securely mounted at one end to the drain 152 and at an opposite end to a collection or storage tank 156. The drain 152 can be constructed in the same manner as drain 40 described hereinbefore and illustrated in FIG. 1. In some environments, spilled fluid will flow from the spill container 130 to the storage tank 156 by force of gravity. However, a suitable pump (not shown) can be provided in the conduit 154 to force flow to the storage tank 156. The storage tank 156 can be vented to atmosphere through a filter (not shown).

The circular bottom opening 138 can have two circular rings 158 and 160, compare circular rings 56 and 58, mounted to thereto. The upper and bottom circular rings 158 and 160 each have a circular opening therethrough which aligns with the other when the upper and bottom circular rings 158 and 160 are mounted to one another. The bottom circular ring can have a collar (see element 64) projecting outward there from. The collar is adapted to be received through the circular opening in the upper ring 158 so that the upper and bottom circular rings 158 and 160 are aligned with each other. A plurality of bolts (compare bolts 39) that are secured to the outer circumference of the open circular bottom opening 136 can be attached to holes which extend through the upper and bottom circular rings, respectively.

In a preferred embodiment, the circular rings 158 and 160 can have a plurality of openings about the circumference and extending therethrough. A plurality of chains or straps 146 can be connected at an inner end 146*b* to the openings extending through the circular rings 158 and 160. The outer end 146*a* can be secured to the underside of the rig floor 132. The side walls 134 of the concave container 131 can be supported and held in place by the plurality of chains or straps 146. The side walls 134 of the concave container 131 formed of a flexible, leakproof material has the generally a cone-like shape of an inverted concave container and is provided with an open top 136 for catching fluid spilled on the rig floor 132 and an circular bottom opening 138 adapted to receive a tubular member so that the latter can extend through an opening that has the generally a cone-like shape of an inverted concave container and is provided with an open top 136 for catching fluid spilled on the rig floor 132 and an circular bottom opening 138 adapted to receive a tubular member so that the latter can extend through an opening. The side walls 134 can have openings 152 into which drains (compare drains 40) can be mounted near the circular bottom opening 138 so that oil collected in the spill container 130 can be directed out of the circular bottom opening 138 and into a conduit (not shown) as described hereinbefore.

A stack 162, projecting up from a well head 164 has the pipe 138 extending therethrough. The circular rings 158 and 160 are mounted to the well head by an elastic strap or a ratchet strand 166 to secure the concave container 131 in place.

As shown in FIG. 1, to enable the spill container 130 to handle a higher weight of fluid, a plurality of additional hangers 168 and 170 can be mounted at one end by hooks to the underside of the rig floor 132 and at the opposite end to the sidewall 134 of the spill container 130.

Figure 6:
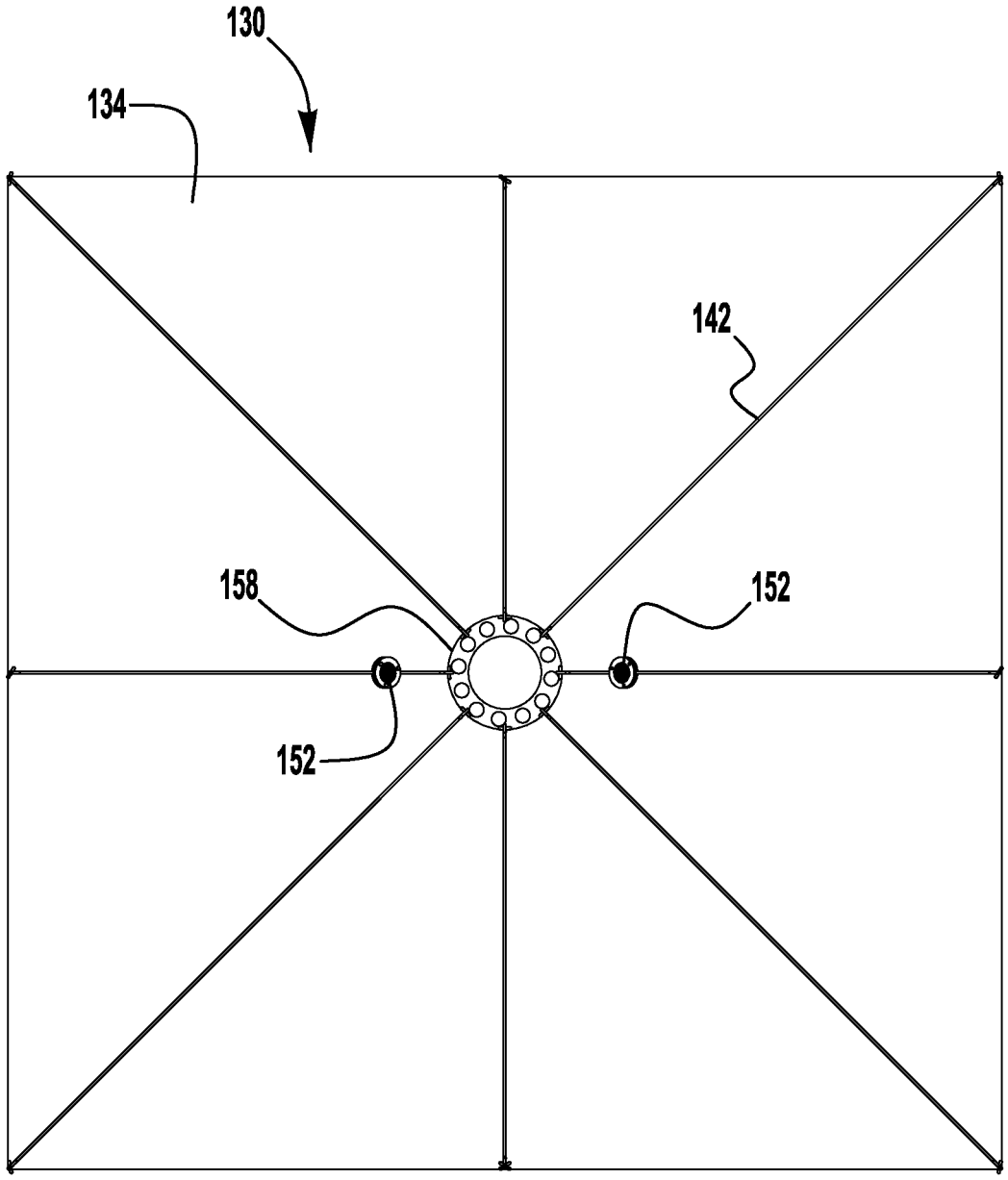

Referring to FIG. 6, there is shown a view through 6-6 of FIG. 5 of the spill container 130 is mounted to the underside of the rig floor 132.

Figure 7:
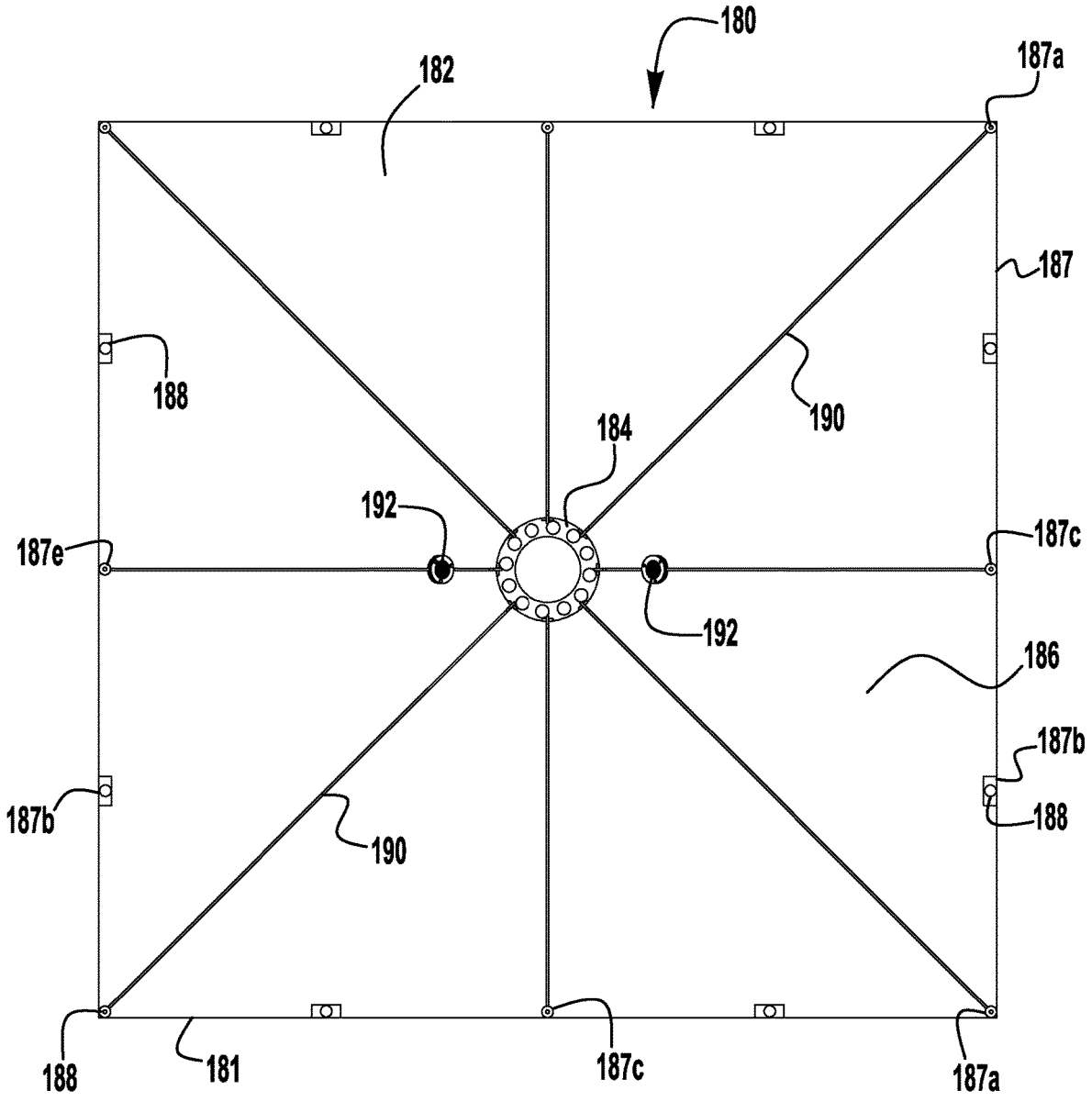

Referring to FIG. 7, a spill container 180, which is an alternative embodiment of the spill container 130 mounted to the underside of the rig floor 132 of FIG. 5, is illustrated. The spill container 180 can be mounted to the underside of the rig floor 132. Spill container 180, as generally shown and described with reference to FIG. 1, includes an inverted concave container 181 and is provided with side walls 186 of the spill container 180 formed of a flexible, leakproof material has the generally a cone-like shape of an inverted concave container and is provided with an open top 182 for catching fluid spilled on the rig floor 132 and an circular bottom opening 184 adapted to receive the tubular member 138 so that the latter can extend through an opening 140 in rig floor 132 and downward below the spill container 180 as described hereinbefore.

Although the side walls 186 of the spill container 180 are shown in a taut condition, they may curve outwardly so that they can be mounted to the underside of the rig floor 132 in a loose fashion. The outer border 187 of the open top 182 can be mounted by a plurality of hangers 146 extending there about and connected at one end to reinforced holes 188, such as by grommets, disposed about the outer border 187 at locations such as at the corners 187*a* and intermediate locations 187*b* between the corners.

The opposite end of the hangers can be mounted to hooks 148 secured to the underside of the rig floor 132. The outer circumference of the open circular bottom opening 184 has a plurality of hooks 150 attached thereto.

A plurality of reinforcing strips 190 are secured to the side walls 186 of the spill container 180 and extend from the circular bottom opening 184 to the outer border 187 at locations such as at the corners 187*a* and intermediate locations 187*c* between the corners. The strips 190 are provided to strengthen the side walls 186.

One or more drains 192 can be mounted in the sidewall 186 near the circular bottom opening 184 so that fluid collected in the spill container 180 can be directed out of the spill container and into a conduit (not shown) which is securely mounted at one end to the drain 192 and at an opposite end to a collection or storage tank (not shown).

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A spill container to be mounted below a rig floor, comprising:

a collapsible concave container having an open top for catching fluid spilled on the rig floor, and a circular bottom opening adapted to receive a tubular member extending through the rig floor and downward below the concave container;

side walls of the concave container from the open top to the circular bottom opening;

the open top of the concave container having a plurality of hangers extending there about to mount to the rig floor; and an outer circumference of the open circular bottom opening having a plurality of hooks attached thereto for mounting to circular rings through which the tubular member extends outwardly therefrom; and a plurality of additional hangers mounted at one end by hooks to an underside of the rig floor and at the opposite end to the sidewalls of the concave container.

2. The spill container of claim 1, wherein the opposite end of the additional hangers are secured at a location between the circular bottom opening and the open top of the concave container.

3. The spill container of claim 1, further including one or more drains mounted in the sidewalls near the circular bottom opening so that fluid collected in the concave container is directed into a conduit, which is securely mounted at one end to the one or more drains and at an opposite end to a storage tank.

4. The spill container of claim 3, wherein the one or more drains are constructed of an outer ring, whereby the outer ring is disposed on an outer surface of the sidewalls at an opening through the sidewalls.

5. The spill container of claim 4, wherein an o-ring is disposed against an inner surface of the sidewalls about the opening through the sidewalls.

6. The spill container of claim 5, wherein a screen is placed upon the o-ring and secured in place with an inner ring, such that the inner and outer rings are connected to each other.

7. The spill container of claim 6, wherein the circular bottom opening has an upper and bottom circular rings mounted thereto, each having a circular opening, respectively, therethrough which align with each other when the upper and bottom circular rings are mounted to each other.

8. The spill container of claim 7, wherein the rings are mounted to the underside of the rig floor by a plurality of adjustable chains which are connected at an outer end to the underside of the rig floor and at an opposite inner end to the openings in the two upper and bottom circular rings.

9. The spill container of claim 7, wherein the rings are mounted to the underside of the rig floor by a plurality of adjustable straps which are connected at an outer end to the underside of the rig floor and at an opposite inner end to the openings in the two upper and bottom circular rings.

10. The spill container of claim 1, wherein a plurality of reinforcing strips are secured to the side walls of the collapsible concave container and extend from the circular bottom opening to an outer border about the open top of the concave container.

11. A spill container to be mounted below a rig floor, comprising:

a first circular ring mounted to the rig floor;

a collapsible concave container mounted to the circular ring, having an open top for catching fluid spilled on the rig floor, and a circular bottom opening adapted to receive a tubular member extending through the rig floor and downward below the concave container;

side walls of the concave container from the open top to the circular bottom opening;

the open top of the concave container having a plurality of hangers extending there about to mount to the circular ring;

an outer circumference of the open circular bottom opening having a plurality of hooks attached thereto for mounting to a second circular ring; and one or more drains mounted in the sidewalls near the circular bottom opening so that fluid collected in the concave container is directed into a conduit, which is securely mounted at one end to the one or more drains and at an opposite end to a storage tank.

12. The spill container of claim 11, wherein the first circular ring is mounted to an underside of the rig floor by a plurality of adjustable straps which are connected at an outer end to the underside of the rig floor and at an opposite inner end to the first circular ring.

13. The spill container of claim 11, wherein the one or more drains are constructed of an outer ring, whereby the outer ring is disposed on an outer surface of the sidewalls at an opening through the sidewalls.

14. The spill container of claim 11, wherein a plurality of reinforcing strips are secured to the side walls of the collapsible concave container and extend from the circular bottom opening to an outer border about the open top of the concave container.

15. The spill container of claim 11, wherein an o-ring is disposed against an inner surface of the sidewalls about a drain opening through the sidewalls.

16. The spill container of claim 15, wherein a screen is placed upon the o-ring and secured in place with an inner ring, such that the inner and outer rings are connected to each other.

17. The spill container of claim 16, wherein the circular bottom opening has an upper and bottom circular rings mounted thereto, each having a circular opening, respectively, therethrough which align with each other when the upper and bottom circular rings are mounted to each other.

* * * * *